US008864271B2

(12) United States Patent
Abe

(10) Patent No.: US 8,864,271 B2
(45) Date of Patent: Oct. 21, 2014

(54) MEDIUM TRANSPORTATION DEVICE AND RECORDING APPARATUS

(71) Applicant: Seiko Epson Corporation, Tokyo (JP)

(72) Inventor: Takahiro Abe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 34 days.

(21) Appl. No.: 13/693,475

(22) Filed: Dec. 4, 2012

(65) Prior Publication Data

US 2013/0141487 A1 Jun. 6, 2013

(30) Foreign Application Priority Data

Dec. 6, 2011 (JP) ..... 2011-266551

(51) Int. Cl.
*B41J 29/38* (2006.01)
*B41J 11/00* (2006.01)
*B41J 13/00* (2006.01)

(52) U.S. Cl.
CPC ..... *B41J 11/00* (2013.01); *B41J 13/0018* (2013.01); *B41J 11/0095* (2013.01)
USPC ..... 347/16

(58) Field of Classification Search
CPC ..... B41J 11/00; B41J 11/0095
USPC ..... 347/16, 101, 104; 271/265.01
See application file for complete search history.

(56) References Cited

U.S. PATENT DOCUMENTS 7,147,316 B2 12/2006 Hayashi et al.
7,600,866 B2 * 10/2009 Takeshita et al. ..... 347/101
8,632,156 B2 * 1/2014 Korogi et al. ..... 347/16

FOREIGN PATENT DOCUMENTS

JP 2003-267591 A 9/2003
JP 2007-217176 A 8/2007

* cited by examiner

*Primary Examiner* — An Do
(74) *Attorney, Agent, or Firm* — Nutter McClennen & Fish LLP

(57) ABSTRACT

A pair of transportation rollers is configured such that a transportation driven roller is disposed at a position which is displaced downstream with respect to a position vertically above a transportation driving roller and feeds out the paper sheet guiding in obliquely downward direction. The entering direction of the paper sheet fed out from the pair of transportation rollers is determined so as to intersect the plane of the holding surface of the support table. A translucent glass that serves as a detection window of an imaging unit disposed at a position opposite to the paper sheet with respect to the holding surface is located downstream in the transportation direction with respect to an intersection position between the entering direction of the paper sheet and the holding surface. Specifically, the translucent glass is located in the proximity of an abutment position where the paper sheet abuts against the holding surface.

5 Claims, 8 Drawing Sheets

TEMPLATE DEFINING

TEMPLATE MATCHING

MEDIUM TRANSPORTATION DEVICE AND RECORDING APPARATUS

BACKGROUND

1. Technical Field

The present invention relates to a medium transportation device that transports media such as sheets of paper for printing and a recording apparatus.

2. Related Art

JP-A-2007-217176 and JP-A-2003-267591 disclose a recording apparatus including a transportation device that transports media (recording media) such as sheets of paper and a recording unit such as a recording head that performs printing on a portion of the medium which is held by a medium holding member while the medium is transported by the transportation device.

In the recording apparatus (image forming device) described in JP-A-2007-217176, the images of the surface feature of the transported medium are sequentially captured by using a camera (imaging device), and two images in a time series are compared so as to calculate the transportation distance of a target pattern in the image. Then, the actual transportation distance of the medium is calculated by summing the transportation distances of the target pattern.

Further, in the recording apparatus (printer) described in JP-A-2003-267591, laser light is emitted onto the medium such as a paper sheet. The transportation distance of the medium is detected by comparing speckle patterns generated in the light reflected from the medium in a time series.

In the medium transportation device of the recording apparatus described in JP-A-2007-217176, the camera is disposed on the side of a recording surface of the medium at a position downstream with respect to a pair of transportation rollers in the transportation direction. If the medium is lifted from a holding surface of the medium holding member, for example, the distance between the camera and the medium changes and the image captured by the camera becomes out of focus. As a result, the image of the medium becomes blurred, which causes a problem that the detection accuracy of the transportation distance of the medium decreases.

Further, the medium transportation device of the recording apparatus described in JP-A-2003-267591 has a similar problem in that, if the medium is lifted from a holding surface of the medium holding member, the speckle pattern generated in the light reflected from the medium is displaced and the detection accuracy of the transportation distance of the medium decreases.

Particularly, when the leading edge of the medium does not reach a downstream pair of transportation rollers, which is a component of the transportation unit, immediately after the medium is fed out in a transportation process, the medium is often lifted from the holding surface, since the medium is held between an upstream pair of transportation rollers only. Further, in JP-A-2007-217176 and JPA-2003-267591, a portion of the medium which is not supported on the medium holding surface serves as a detection area. This causes a problem that the detection accuracy of the medium transportation distance tends to decrease, since the detection area of the medium may be displaced not only in the direction away from the holding surface but also in the opposite direction and the paper sheet may be easily out of the expected transportation path.

SUMMARY

An advantage of some aspects of the invention is that a medium transportation device and a recording apparatus that can reduce a decrease in detection accuracy of a medium which is caused by the medium as a detection target of a detector being out of the expected transportation path is provided.

According to an aspect of the invention, a medium transportation device includes a transportation unit that transports a medium; a medium holding member having a holding surface on which the medium to be transported by the transportation unit is held; a non-contact detector that obtains positional information of the medium by detecting the medium which is held on the holding surface in a non-contact manner; and a transportation control unit that controls transportation by the transportation unit based on the information obtained by the detector, wherein an entering direction of the medium transported by the transportation unit onto the holding surface is determined so as to intersect the plane of the holding surface, and the detector is disposed such that a detection area is located at a position downstream in a transportation direction with respect to the intersection position between the entering direction of the medium and the holding surface.

With this configuration, since the medium transported by the transportation unit is advanced onto the holding surface so as to intersect the plane of the holding surface, the medium is pressed against the holding surface at the intersection position or slightly downstream with respect to the intersection position in the transportation direction. Accordingly, the medium is not easily away from the holding surface in the region downstream with respect to the intersection position in the transportation direction. A portion of the medium that corresponding to the region where the medium is not easily away from the holding surface serves as the detection area of the detector. Therefore, it is possible to reduce a decrease in detection accuracy (for example, positional detection accuracy) of the medium which is caused by the medium as a detection target of the detector being out of the expected transportation path.

In the medium transportation device according to the aspect of the invention, it is preferable that the detector is disposed at a position opposite to the medium with respect to the holding surface.

With this configuration, the detector is disposed at a position opposite to the medium with respect to the holding surface, and the surface of the medium which faces to the holding surface serves as the detection target. Accordingly, since the distance between the detector and the surface of the medium which faces to the holding surface is kept constant regardless of the thickness of the medium, the detection accuracy of the detector can be relatively improved compared to the configuration in which the surface of the medium which does not face to the holding surface serves as the detection target.

In the medium transportation device according to the aspect of the invention, it is preferable that the detector has a detection window on the holding surface, and the detection window is disposed at a position downstream with respect to the intersection position in the transportation direction.

With this configuration, since the detection window is disposed on the holding surface at a position downstream with respect to the intersection position in the transportation direction, the surface of the medium which faces to the holding surface of a portion of the medium which is pressed against the holding surface through the detection window can serve as the detection area.

In the medium transportation device according to the aspect of the invention, it is preferable that the detector is an optical detector that obtains the positional information of the medium based on a light reflected from the medium.

With this configuration, the detector receives the light reflected from the medium and obtains positional information of the medium based on the result from the received light. Since the detector is an optical type, it is possible to obtain positional information of the medium with relatively high detection accuracy.

In the medium transportation device according to the aspect of the invention, it is preferable that the transportation control unit calculates an actual transportation distance of the medium based on the positional information of the medium obtained by the detector and controls the transportation unit with feedback control so as to approximate the actual transportation distance to a target transportation distance.

With this configuration, since the transportation control unit controls the transportation unit with feedback control so as to approximate the actual transportation distance of the medium which is calculated based on the information obtained by the detector to the target transportation distance, the accuracy of the transportation position of the medium is improved.

According to another aspect of the invention, a recording apparatus includes the medium transportation device according to the above aspect; and a recording unit that performs recording by ejecting liquid onto the medium held on the holding surface, wherein the intersection position is located at a position upstream with respect to a recording area of the recording unit in the transportation direction, and the detector is disposed such that the detection area is located at a position downstream with respect to the intersection position in the transportation direction and upstream with respect to the recording area in the transportation direction.

With this configuration, since the detector is disposed such that the detection area is located at a position downstream with respect to the intersection position in the transportation direction and upstream with respect to the recording area in the transportation direction, it becomes easy to prevent lifting of the medium from the holding surface, for example, due to cockling which occurs when the medium swells with ink which is applied on the medium in the recording area and the medium is wrinkled. As a result, the detection accuracy of the detector is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
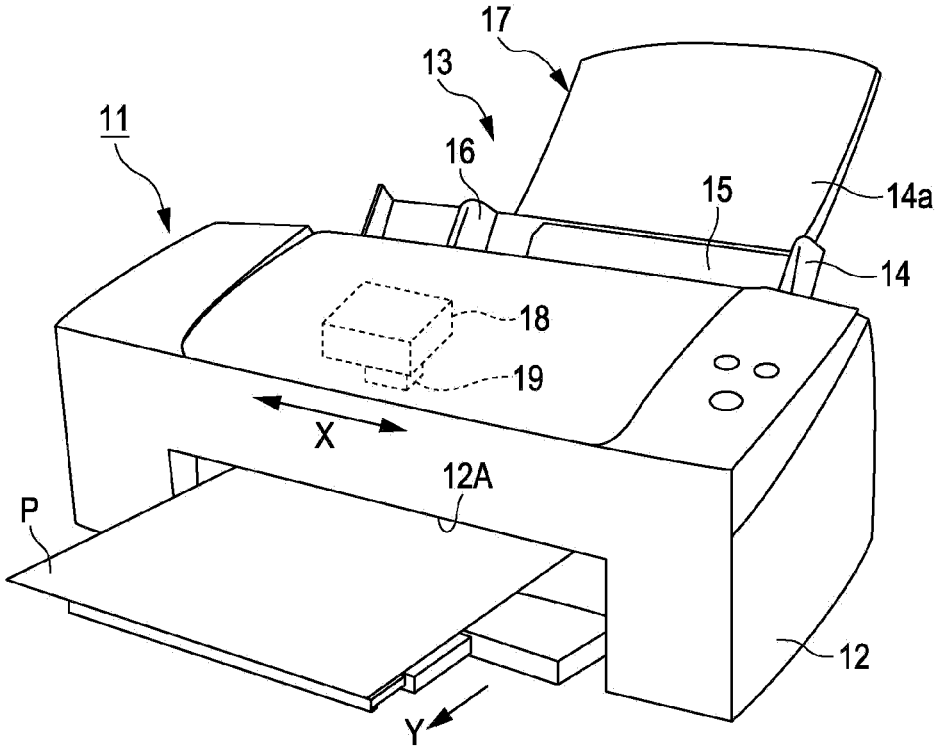
FIG. 1 is a perspective view of a printer according to one embodiment.

An embodiment in which a recording apparatus including a medium transportation device according to the invention is implemented as an ink jet printer will be described below with reference to FIGS. 1 to 9. As shown in FIG. 1, the ink jet printer (hereinafter, simply referred to as "printer 11") as an example of the recording apparatus is provided with an auto sheet feeder 13 on the back of a main body 12 so as to feed paper sheets P as an example of medium. The auto sheet feeder 13 includes a paper sheet guide 17 having a sheet feeding tray 14, a hopper 15, an edge guide 16, and a paper sheet support 14*a*. The auto sheet feeder 13 feeds the paper sheets that are set on the paper sheet guide 17 one by one into the main body 12.

A carriage 18 is disposed in the main body 12 so as to reciprocate in a main scan direction X. Further, a recording head 19 is mounted on the underside of the carriage 18. The printer 11 performs printing on the paper sheet P during a transportation process for moving the carriage 18 in the main scan direction X by alternatively repeating a recording operation in which ink droplets are ejected from the recording head 19 onto the surface of the paper sheet P, and a paper feed operation in which the paper sheet P is transported by a required transportation distance in a sub-scan direction Y (transportation direction), so that images are printed according to the supplied print data. After printing, the paper sheets P are output from an output port 12A that is open to the lower front surface of the main body 12. In this embodiment, an example of the recording unit is formed by the carriage 18 and the recording head 19.

Figure 2:
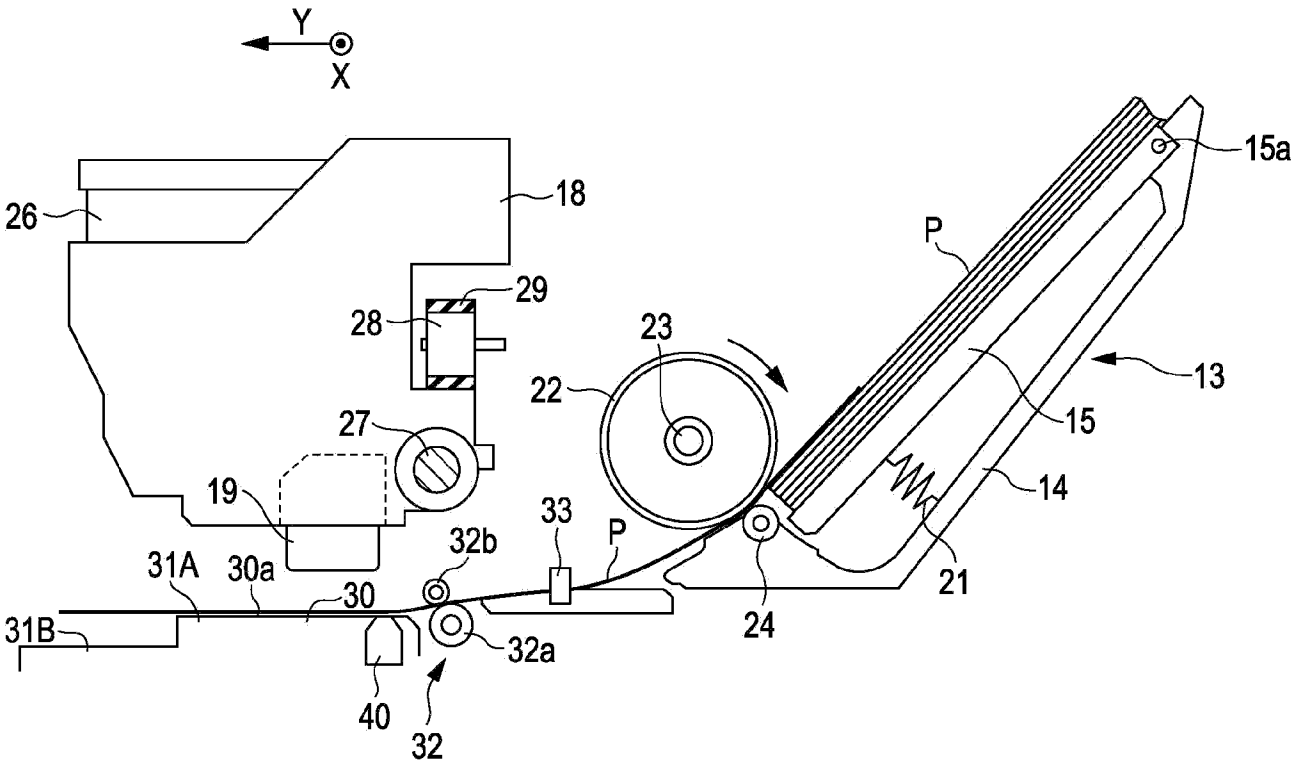
FIG. 2 is a schematic side view of an essential part of a transportation device.

As shown in FIG. 2, the hopper 15 is supported on the upper surface of the sheet feeding tray 14 that is disposed inclined on the back of the main body 12 so that the hopper 15 is movable about a shaft 15*a* at the upper end thereof within a predetermined range of angles. The hopper 15 is biased by a compression spring 21 interposed between the hopper 15 and the sheet feeding tray 14 in the direction away from the sheet feeding tray 14 (upper left direction in FIG. 2).

A sheet feeding roller 22 in a cylindrical shape is disposed at the proximity of the lower end of the hopper 15 so as to be rotatable about a rotation shaft 23. Further, a retard roller 24 is disposed at a position opposite the sheet feeding roller 22. The hopper 15 and the retard roller 24 together move between a sheet feeding position shown in FIG. 2 and a retracted position away from the sheet feeding roller 22.

As shown in FIG. 2, the carriage 18 on which an ink cartridge 26 is mounted is disposed at a position downstream with respect to the auto sheet feeder 13 in the transportation direction Y of the paper sheet P so as to be movable along a guide shaft 27 in the main scan direction X (in the direction perpendicular to the sheet of FIG. 2). The backside (right side in FIG. 2) of the carriage 18 is secured on part of an endless timing belt 29 which is running on a pair of pulleys 28 (only one of the pair is shown in FIG. 2) that are positioned apart from each other by a specified distance in the main scan direction X. When the timing belt 29 rotates in forward and backward directions, the carriage 18 reciprocates in the main scan direction X. A support table 30 as an example of medium holding member is disposed below the recording head 19 mounted on the underside of the carriage 18 so as to define a distance between the recording head 19 and the paper sheet P. The support table 30 extends in the main scan direction X slightly longer than the assumed maximum width of the paper sheet P and has a holding surface 30*a* on which the paper sheet P is held. The support table 30 according to this embodiment includes a first support section 31A and a second support section 31B. The first support section 31A is disposed at a position that opposes the recording head 19 and has a holding surface having a specified width in the transportation direction Y. The second support section 31B is disposed at a position downstream with respect to the first support section 31A in the transportation direction Y and has a holding surface located at a level lower than the holding surface of the first support section 31A.

A pair of transportation rollers 32 (a pair of paper feed rollers) is disposed at a position upstream (right side in FIG. 2) with respect to the support table 30 in the transportation direction Y. The pair of transportation rollers 32 is composed of a transportation driving roller 32*a* and a transportation driven roller 32*b*. An optical sheet detecting sensor 33 that detects an end (for example, a leading edge) of the paper sheet P in the transportation direction is disposed between the sheet feeding roller 22 and the pair of transportation rollers 32.

During printing shown in FIG. 2, the retard roller 24 and the hopper 15 is positioned at the sheet feeding position shown in FIG. 2. When the sheet feeding roller 22 rotates, the uppermost sheet of a stack of the paper sheets P on the hopper 15 is fed out. While printing is performed on the preceding paper sheet P, the subsequent paper sheet P is fed out by rotation of the sheet feeding roller 22 with a predetermined space being kept between the preceding paper sheet P and the subsequent paper sheet P.

Once the paper sheet P is fed out, the paper sheet P is advanced to a print start position by rotation of the pair of transportation rollers 32 in the state being held on the holding surface 30*a* of the support table 30. Then, printing is performed on the paper sheet P by alternatively repeating the recording operation by the recording head 19 and the transportation operation (paper feed operation) by the pair of transportation rollers 32 and the like. During the process of transportation operation, a slight slippage occurs between the paper sheet P and the pair of transportation rollers 32. As a result, a target transportation distance of the paper sheet P being transported to the next recording position and an actual transportation distance of the paper sheet P being actually transported to the next recording position slightly differ by the amount of the slippage. In this embodiment, positional information of the paper sheet P are sequentially detected, and each transportation distance between the respective positions of the paper sheet P (unit transportation distance) is calculated based on the detected positional information. Then, the actual transportation distance of the paper sheet P being transported in one transportation process is obtained by summing the calculated unit transportation distances. Then, the transportation operation is controlled with feedback control in which a specified feedback correction calculation for reducing the difference between the actual transportation distance and the target transportation distance is applied to the next required transportation distance based on the obtained actual transportation distance and the target transportation distance so as to derive the next target transportation distance.

In this embodiment, as shown in FIG. 2, an imaging unit 40 that is capable of imaging the backside of the paper sheet P (the surface of the paper sheet P which faces to the holding surface) is provided as an example of detector that detects positional information of the paper sheet P and is secured on the support table 30 at a position opposite to the paper sheet P with respect to the holding surface 30*a*. The imaging unit 40 captures the image of the texture of the paper sheet P (paper surface pattern) and outputs the images of the texture sequentially captured at each of the paper sheet positions at a predetermined time interval (unit drive time). In this embodiment, the image of the texture that is captured by the imaging unit 40 at each transportation position of the paper sheet P corresponds to the positional information of the paper sheet P.

Figure 3:
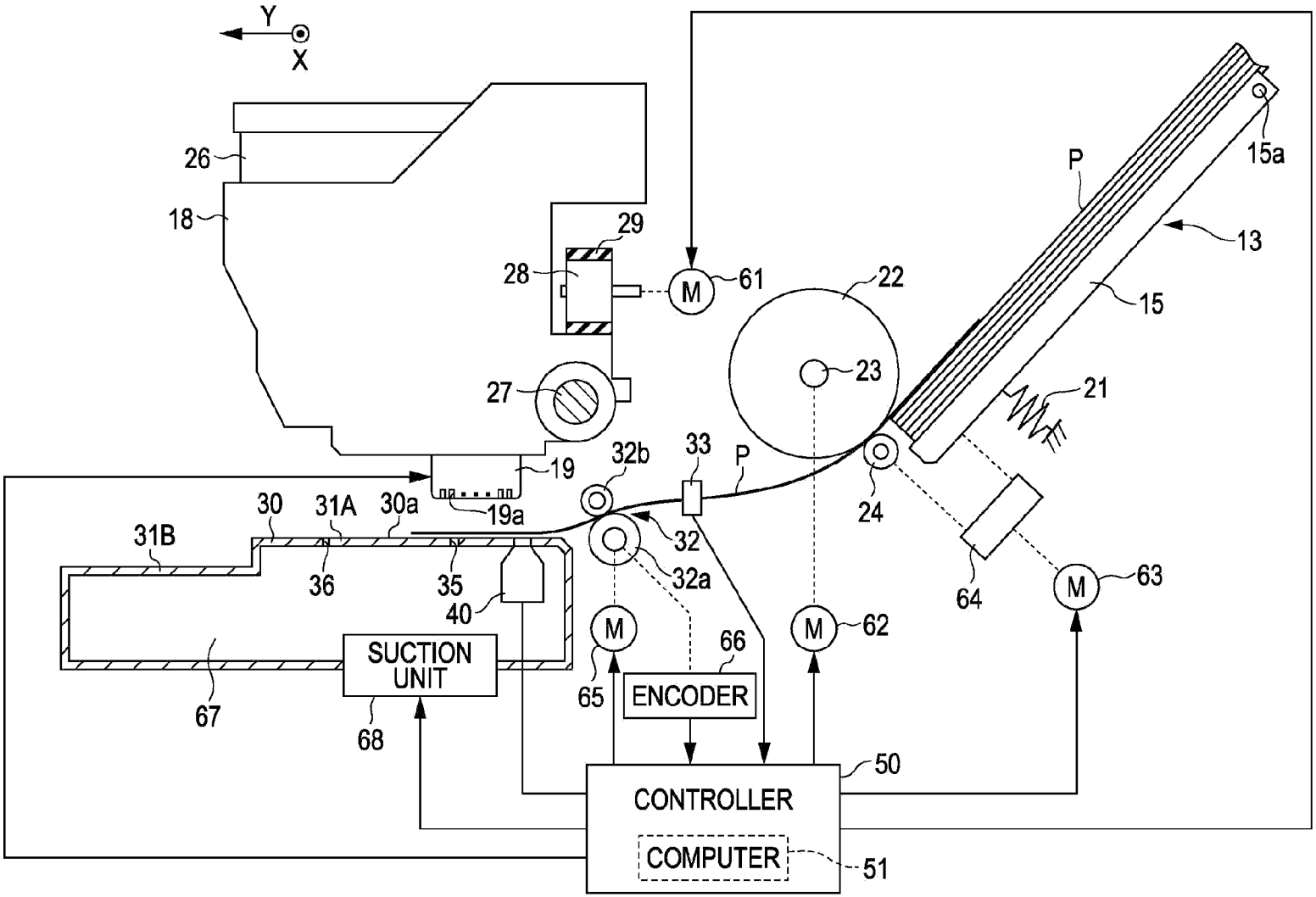
FIG. 3 is a schematic view of an electric configuration of the printer.

Next, an electric configuration of the printer 11 will be described below with reference to FIG. 3. As shown in FIG. 3, the printer 11 includes a controller 50 that performs various controls such as transportation control and printing control. The controller 50 includes a computer 51 (microprocessor). In this embodiment, an example of the transportation control unit is formed by the controller 50.

The computer 51 interprets commands in the print data received from a host device (not shown) and performs transportation control such as sheet feeding, transportation (paper feed) and sheet output, and movement control of the carriage 18 according to the interpreted commands. That is, the computer 51 reads programs required for printing, including a transportation control program which is not shown, from a memory and performs those programs according to the commands so as to perform sheet feeding control, transportation control, printing control, sheet output control and the like. The computer 51 performs speed control of the paper sheet P according to a predetermined speed control data during performing of transportation control by referring to the speed control data for transportation which are stored in the memory.

The computer 51 acquires head control data by performing a specified image processing to the print image data contained in the print data, including a processing such as rearranging dots according to the nozzle order of the recording head 19, and transmits the acquired head control data to a head drive circuit in the recording head 19, which is not shown in the figure. The head drive circuit drives piezoelectric elements for each of nozzles 19*a* selected based on the head control data so as to eject ink droplets from the selected nozzles 19*a*.

As shown in FIG. 3, the controller 50 is electrically connected to a carriage motor 61, a feed motor 62, a sub-motor 63 and a transportation motor 65. The controller 50 drives the carriage motor 61 to rotate in forward and backward directions and rotate the driving pulley 28 which is connected to the output shaft of the carriage motor 61 in forward and backward directions so as to rotate the timing belt 29 in forward and backward directions, thereby reciprocating the carriage 18 in the main scan direction X. The ink droplets are ejected from the recording head 19 in accordance with timings during movement of the carriage 18.

Further, as shown in FIG. 3, the controller 50 drives the sub-motor 63 during sheet feeding to move the hopper 15 and the retard roller 24 which are connected to the output shaft of the sub-motor 63 via a power transmission mechanism 64 from the retracted position to the sheet feeding position shown in FIG. 3. When the hopper 15 and the retard roller 24 are in the sheet feeding position, the controller 50 drives the feed motor 62 to rotate the sheet feeding roller 22, thereby feeding the uppermost sheet of a stack of the paper sheets P on the hopper 15.

Further, the controller 50 drives the transportation motor 65 to rotate the transportation driving roller 32*a* which is connected to the output shaft of the transportation motor 65 via a gear train (not shown) so as to perform transportation (paper feed) of the paper sheet P by the pair of transportation rollers 32. During sheet feeding, the paper sheet P is advanced to the print start position by rotation of the sheet feeding roller 22 and the pair of transportation rollers 32. When the controller 50 drives the transportation motor 65 to rotate the pair of transportation rollers 32, intermittent transportation (paper feed) of the paper sheet P is performed. During this transportation of the paper sheet P, the controller 50 inputs pulse signals having a pulse number in proportion to the rotation amount of the transportation motor 65 from an encoder 66 (for example, a rotary encoder) that detects rotation of the output shaft of the transportation motor 65 or the rotation shaft of the transportation driving roller 32*a*. In this embodiment, the transportation unit is formed by the transportation motor 65, the pair of transportation rollers 32 and the like.

The controller 50 is electrically connected to the sheet detecting sensor 33. The sheet detecting sensor 33 detects the leading edge of the paper sheet P at a position in a feeding path of the paper sheet P and outputs an on/off signal to the controller 50 so as to turn off when detecting the existence of the paper sheet P and turn on when detecting the absence of the paper sheet P. When the sheet detecting sensor 33 detects the leading edge of the paper sheet P (absence of the paper sheet P→existence of the paper sheet P), the controller 50 controls a first counter, which is not shown, to count the number of pulse edges of pulse signals that are input from the encoder 66, taking the position apart from the detected position by a specified distance downstream in the transportation direction Y (for example, the position of the most upstream nozzle) as the origin, and identifies the transportation position of the paper sheet P based on the counted value.

Moreover, the controller 50 controls a second counter, which is not shown, to count the relative position of the paper sheet P from the transportation start position (previous recording position) to the transportation end position (next recording position) in one transportation operation process. More specifically, the second counter sets a value that corresponds to a target transportation distance of the paper sheet P prior to start of the transportation operation. Once transportation of the paper sheet P starts, the value counted by the second counter is decremented (subtracted) by 1 each time when the pulse edge of pulse signal is input from the encoder 66. As a result, the second counter counts the remaining transportation distance to the target position. Based on the counted value of the second counter, the controller 50 identifies the transportation position (relative position) of the paper sheet P in one transportation segment in a sequential manner and controls the speed of the transportation motor 65 according to a predetermined speed profile by instructing a speed instruction value depending on the transportation position to a motor driver (not shown) by referring to the speed control data stored in the memory.

The controller 50 is electrically connected to a suction device 68 having a pump (not shown in the figure) that exhausts air from a negative pressure chamber 67 in the support table 30 which is formed in a box-shape. When negative pressure is applied to the negative pressure chamber 67 by actuating a suction device 68, suction holes 35, 36 that are open to the holding surface 30*a* of the support table 30 are subject to negative pressure. This causes a suction force which allows the paper sheet P to be attached on the holding surface 30*a*. Accordingly, the paper sheet P is transported in the state being in close contact with the holding surface 30*a*. As will be described later, in some cases where the leading edge of the paper sheet P is curled, the curl may cause a force to be applied to the paper sheet P to displace (lift) the paper sheet P away from the holding surface 30*a*. When the amount of force that causes the paper sheet P to be displaced away from the holding surface 30*a* is greater than that of the suction force, the paper sheet P can be transported in the state being lifted away from the holding surface 30*a*.

Further, the controller 50 is electrically connected to the imaging unit 40. The controller 50 controls that the image data (frame) captured by the imaging unit 40 is input from the imaging unit 40 at a constant time interval (unit drive time).

Figure 4:
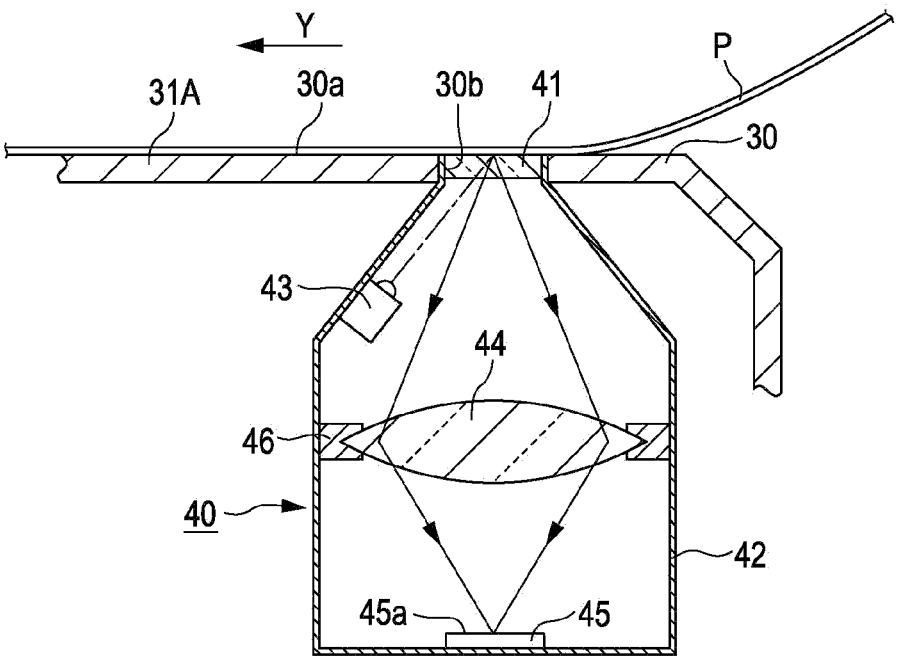
FIG. 4 is a side sectional view which schematically shows an imaging unit.

As shown in FIG. 4, a hole 30*b* as a detection window is open to the holding surface 30*a* of the support table 30 that supports the paper sheet P. The hole 30*b* is formed at a position where all the paper sheets P having minimum to maximum width pass by. The imaging unit 40 has a case 42 of a specified shape and the upper portion of the case 42 is shaped as a frustum of cone with a translucent glass 41 being mounted on the tip (upper end) of the case 42. The imaging unit 40 is assembled to the support table 30 with the translucent glass 41 being fit in the hole 30*b* of the support table 30.

As shown in FIG. 4, a light emitting unit 43 is disposed in the case 42. The light emitting unit 43 is secured on the inner wall of the case 42 via a support bracket, which is not shown, at an angle that allows the light emitting unit 43 to emit a light onto the translucent glass 41. The light emitting unit 43 includes, for example, a light emitting diode (LED). A collective lens 44 is also disposed in the case 42 so as to collect the light which has been emitted from the light emitting unit 43, passed through the translucent glass 41, reflected from the backside of the paper sheet P, and entered back into the case 42. Further, an imaging element 45 having an imaging surface 45*a* is disposed in the case 42 so that the image of the backside of the paper sheet P (image of the texture) collected by the collective lens 44 is formed on the imaging surface 45*a*. The imaging element 45 is formed by, for example, a two-dimensional image sensor (area sensor). The collective lens 44 is held by a holding member 46 in the case 42 at a height that allows the image of the backside of the paper sheet P to be formed on the imaging surface 45*a* of the imaging element 45. In this way, the imaging unit 40 of this embodiment constitutes an optical detector that obtains positional information (texture image) of the paper sheet P based on the light reflected from the paper sheet P.

Figure 5A:
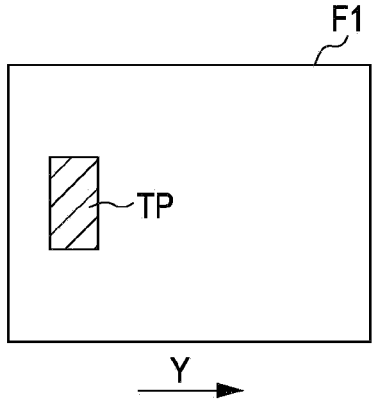
FIGS. 5A and 5B are explanatory views of a template matching process.
Figure 5B:
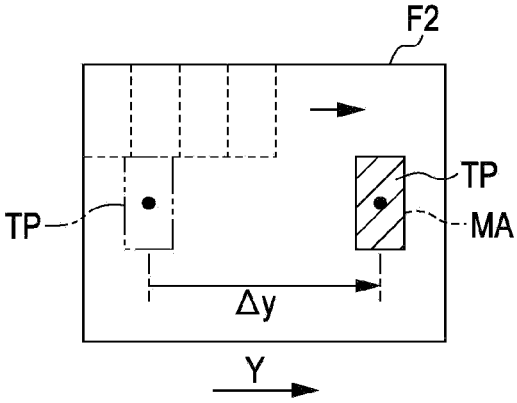

Next, a transportation distance calculation process performed by the computer 51 of the controller 50 will be described below. FIGS. 5A and 5B are two sequential images (frames) that are captured by the imaging unit 40 and are compared in a time series. In images F1 and F2, the texture of the backside of the paper sheet P is imaged. First, in the Nth image F1 shown in FIG. 5A (where N is natural number), a template TP, for example, having a rectangular area is defined at a predetermined position (template defining position) in the upstream region in the transportation direction Y within the image F1. The template defining position is determined such that the rectangular area that is defined as the template TP in the image F1 can be still included in the next frame F2 after the unit drive time has passed. The texture of the template TP is a unique paper surface pattern that is not appear on the remaining area in the backside of the paper sheet P.

Next, a template matching process is performed in the next (N+1)th image F2 shown in FIG. 5B. In the template matching process, the similarity of the template TP that is captured in the previous Nth image to each of the rectangular areas indicated by the dotted lines in the image F2 (the actual rectangular area for each pitch is sufficiently smaller than that is shown in the figure) is sequentially calculated while the template TP shifts on the image F2 so as to find out a position of a matching area MA where the similarity becomes maximum. Then, as a result of the template matching process, when the matching area MA having the maximum similarity to the template TP is found out as shown in FIG. 5B, distance between the template defining position (for example, the central coordinate of the template TP) which is indicated by the dashed two dotted line in image F2 and the position of the matching area MA (for example, the central coordinate of the matching area MA) in the transportation direction Y is calculated. The calculated distance is a shift amount $\Delta y$ per unit drive time.

The computer 51 shown in FIG. 3 obtains the actual transportation distance by summing the shift amounts $\Delta y$ in one transportation process. Then, the computer 51 controls the transportation operation with feedback control in which a specified feedback correction calculation for reducing the difference between the actual transportation distance and the target transportation distance is applied to the next required transportation distance based on the actual transportation distance and the target transportation distance so as to derive the next target transportation distance. During the process of the transportation operation, a slight slippage occurs between the paper sheet P and the pair of transportation rollers 32. As a result, the actual transportation distance of the paper sheet P and the target transportation distance of the paper sheet P slightly differ by the amount of the slippage. In this embodiment, since the computer 51 controls transportation operation with feedback control as mentioned above, it is possible to reduce the variation in transportation distance due to such slippage.

Further, in the imaging unit 40, settings of an optical system such as the collective lens 44 and a positioning of the imaging element 45 are adjusted so that the image of the backside of the paper sheet P that abuts against the holding surface 30*a* is focused. If a portion of the paper sheet P which serves as the detection area for the imaging unit 40 is lifted from the holding surface 30*a*, the imaging unit 40 does not focus on the backside of the paper sheet P. As a consequence, the accuracy of the template matching process decreases, for example, due to blur of the image. That is, if blurred images are compared to each other, miscalculation of the shift amount $\Delta y$ occurs, leading to a relatively large margin of error and an erroneous result of the shift amount $\Delta y$. In this embodiment, in order to minimize occurrence of such miscalculation caused by blur of the image as above mentioned, the paper sheet P is prevented from being lifted from the holding surface 30*a* at least at a position of the translucent glass 41 which serves as the detection window of the imaging unit 40.

Figure 6:
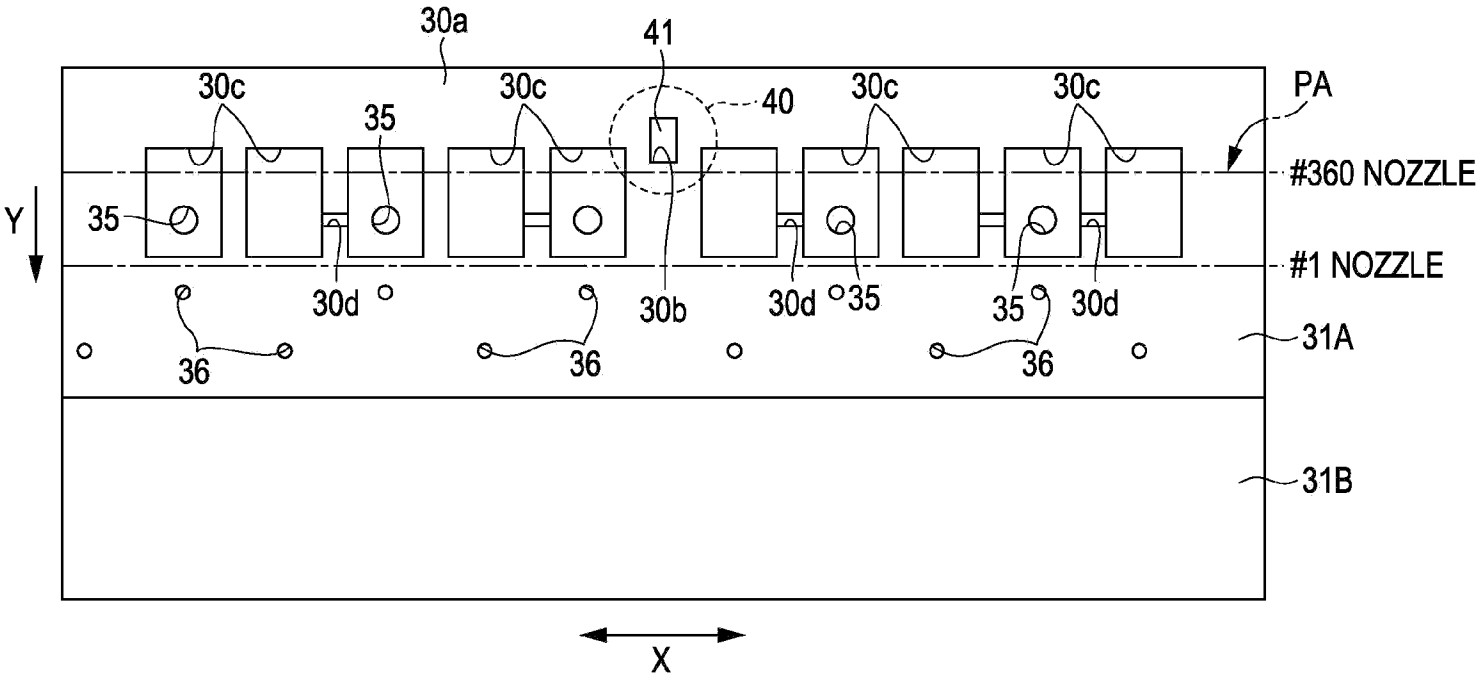
FIG. 6 is a schematic plan view of a support table.

As shown in FIG. 6, the support table 30 includes the first support section 31A which is disposed relatively upstream in the transportation direction Y and the second support section 31B which is disposed downstream with respect to the first support section 31A in the transportation direction Y. A plurality of recesses 30*c* aligned in the main scan direction X are formed on the holding surface 30*a* (top) of the first support section 31A. A first suction hole 35 which is open to the bottom of every other recess 30*c* is formed so as to communicate with the negative pressure chamber 67 in the support table 30. The recess 30*c* having the first suction hole 35 at the bottom and the recess 30*c* not having the first suction hole 35 communicate with each other via a groove 30*d*. Further, a plurality of second suction holes 36 each having the diameter smaller than that of the first suction hole 35 are formed at positions downstream with respect to the recess 30*c* of the first support section 31A in the transportation direction Y with almost equal intervals. The paper sheet P is transported while being attached on the holding surface 30*a* due to the negative pressure applied to the plurality of recess 30*c* and second suction holes 36.

As shown in FIG. 6, in the imaging unit 40, the translucent glass 41 that serves as the detection window which the light reflected from the backside of the paper sheet P passes through is disposed at a position upstream with respect to a position that opposes the most upstream nozzle #360 of the recording head 19 in the transportation direction Y. That is, the translucent glass 41 is disposed at a position upstream in the transportation direction Y with respect to a print area PA (recording area) which is defined as an area between the most upstream nozzle #360 and the most downstream nozzle #1 in the transportation direction Y.

Figure 7A:
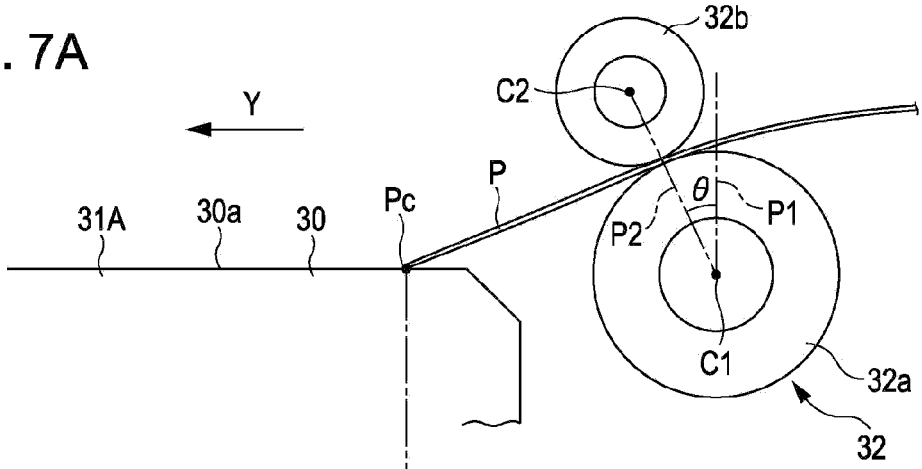
FIGS. 7A and 7B are schematic side views which explains positioning of the imaging unit.

The upstream limit position of the translucent glass 41 that serves as the detection window on the holding surface 30*a* in the transportation direction Y is defined as follows. As shown in FIG. 7A, in the pair of transportation rollers 32 according to this embodiment, the transportation driven roller 32*b* is displaced downstream (left side in FIG. 7A) with respect to the transportation driving roller 32*a* in the transportation direction Y, such that a virtual plane P2 extending between the shaft center C2 of the transportation driven roller 32*b* and the shaft center C1 of the transportation driving roller 32*a* is inclined with respect to the vertical plane P1 extending from the shaft center C1 of the transportation driving roller 32*a* and forms a specified angle $\theta$ of 10 to 20 degrees, for example. That is, the transportation driven roller 32*b* is disposed at a position displaced downstream with respect to a position vertically above the transportation driving roller 32*a* in the transportation direction Y by a specified angle $\theta$. As a result, the paper sheet P is fed out from a position where the paper sheet P is held between the pair of transportation rollers 32 at a specified guide angle in obliquely downward direction. Accordingly, the pair of transportation rollers 32 according to this embodiment is configured such that an entering direction of the paper sheet P being advanced onto the holding surface 30*a* after straightly fed out from the pair of transportation rollers 32 at the guide angle intersects the plane of the holding surface 30*a*. An intersection position Pc where the entering direction of the paper sheet P intersects the plane of the holding surface 30*a* corresponds to an entering position where the leading edge of the paper sheet P straightly fed out from the pair of transportation rollers 32 at the guide angle is advanced onto the holding surface 30*a*.

Figure 7B:
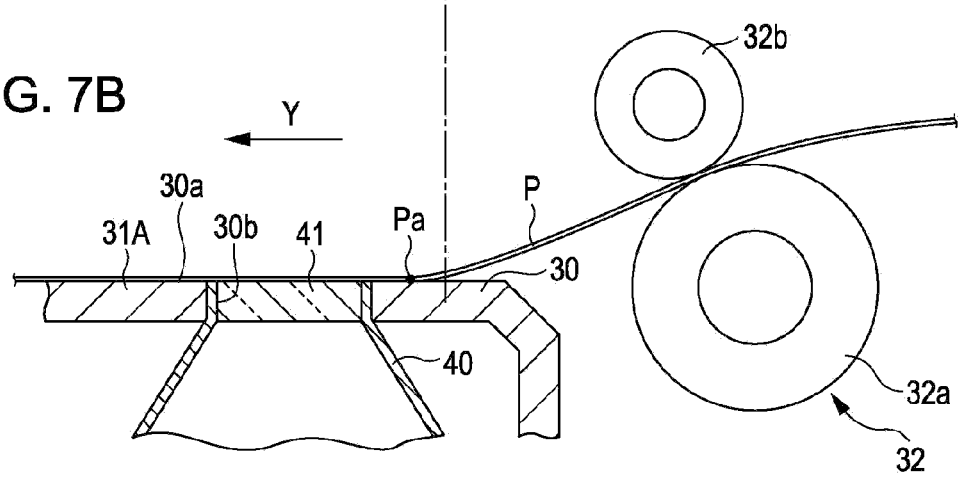

As shown in FIG. 7B, the positioning of the imaging unit 40 is determined such that the translucent glass 41 is located at a position on the holding surface 30*a* downstream with respect to the intersection position Pc in the transportation direction Y. That is, the intersection position Pc is the upstream limit position of the translucent glass 41 in the transportation direction Y. When the paper sheet P that has been advanced onto the holding surface 30*a* as shown in FIG. 7A is further transported, the leading edge of the paper sheet P abuts against the holding surface 30*a* while curving downward as shown in FIG. 7A. As a result, an abutment start position Pa where the paper sheet P starts to abut against the holding surface 30*a* is located downstream with respect to the intersection position Pc in the transportation direction Y. The paper sheet P is pressed against the holding surface 30*a* at a position downstream with respect to the abutment start position Pa in the transportation direction Y. Accordingly, a portion of the paper sheet P downstream with respect to the intersection position Pc in the transportation direction Y is adjacent to or abuts against the translucent glass 41 that is open to the holding surface 30*a*.

In this embodiment, specifically, the positioning of the imaging unit 40 is determined such that the translucent glass 41 is located at a position downstream with respect to the abutment start position Pa in the transportation direction Y. That is, particularly in this embodiment, the abutment start position Pa is the upstream limit position of the translucent glass 41 in the transportation direction Y. Since the paper sheet P is pressed against the holding surface 30*a* at a position downstream with respect to the abutment start position Pa in the transportation direction Y, a portion of the paper sheet P downstream with respect to the abutment start position Pa in the transportation direction Y abuts against the translucent glass 41 that is open to the holding surface 30*a*.

Based on the above-mentioned positioning conditions, according to this embodiment, the translucent glass 41 that serves as the detection window is disposed within an area from the intersection position Pc to the most upstream nozzle

#360 in the transportation direction Y. That is, the positioning of the imaging unit 40 is determined such that the detection area (imaging area) of the imaging unit 40 is located within the area from the intersection position Pc to the most upstream nozzle #360 in the transportation direction Y.

Figure 8A:
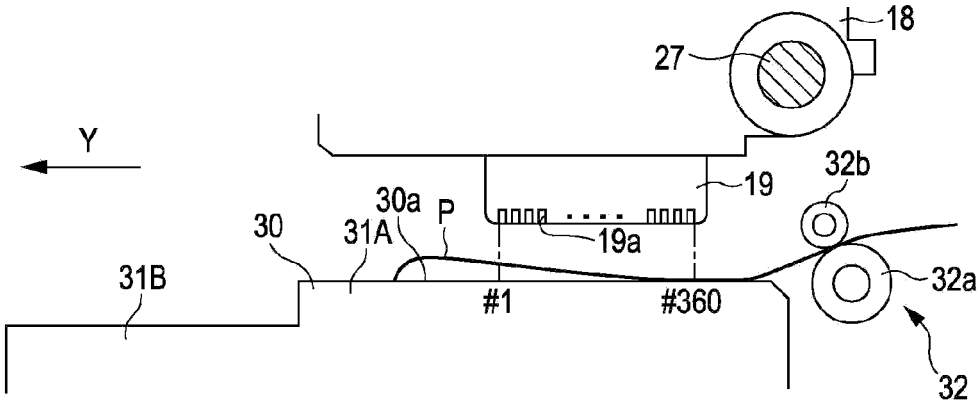
FIGS. 8A and 8B are schematic side views which explains a transportation process of a paper sheet.
Figure 8B:
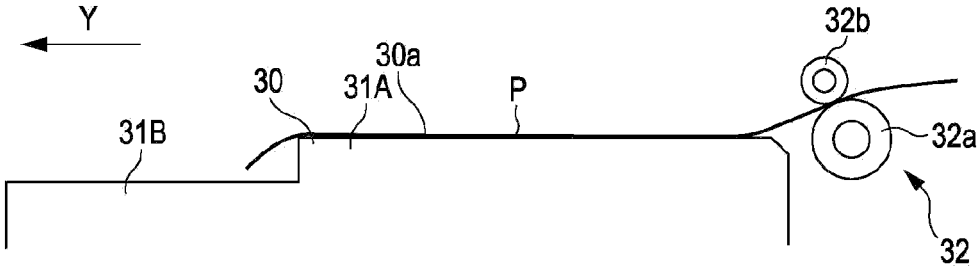

Moreover, as shown in FIGS. 8A and 8B, in some cases, the paper sheet P to be transported has a curled leading edge. When the paper sheet P is positioned within a segment in which the leading edge of the paper sheet P is located on the first support section 31A of the holding surface 30*a* (hereinafter, referred to as "first segment") as shown in FIG. 8A, a portion of the paper sheet P which is pressed against the holding surface 30*a* in the proximity of the abutment start position Pa abuts against the holding surface 30*a*. However, a force from the curl causes a portion of the paper sheet P which is located from the proximity of the abutment start position Pa to the leading edge of the paper sheet P to be lifted from the holding surface 30*a*. When the paper sheet P is in the first segment, the paper sheet P is transported in the state of being lifted up.

Then, as shown in FIG. 8B, the leading edge of the paper sheet P is advanced from the first support section 31A to the second support section 31B that is located at a level lower than the first support section 31A. When the curled leading edge moves down onto the second support section 31B which is at lower level, a portion of the paper sheet P which is located on the first support section 31A comes into close contact with the holding surface 30*a*. Accordingly, in the second segment after the leading edge of the paper sheet P reaches the second support section 31B, the paper sheet P is transported in the state being in close contact with the holding surface 30*a* of the first support section 31A.

Figure 9:
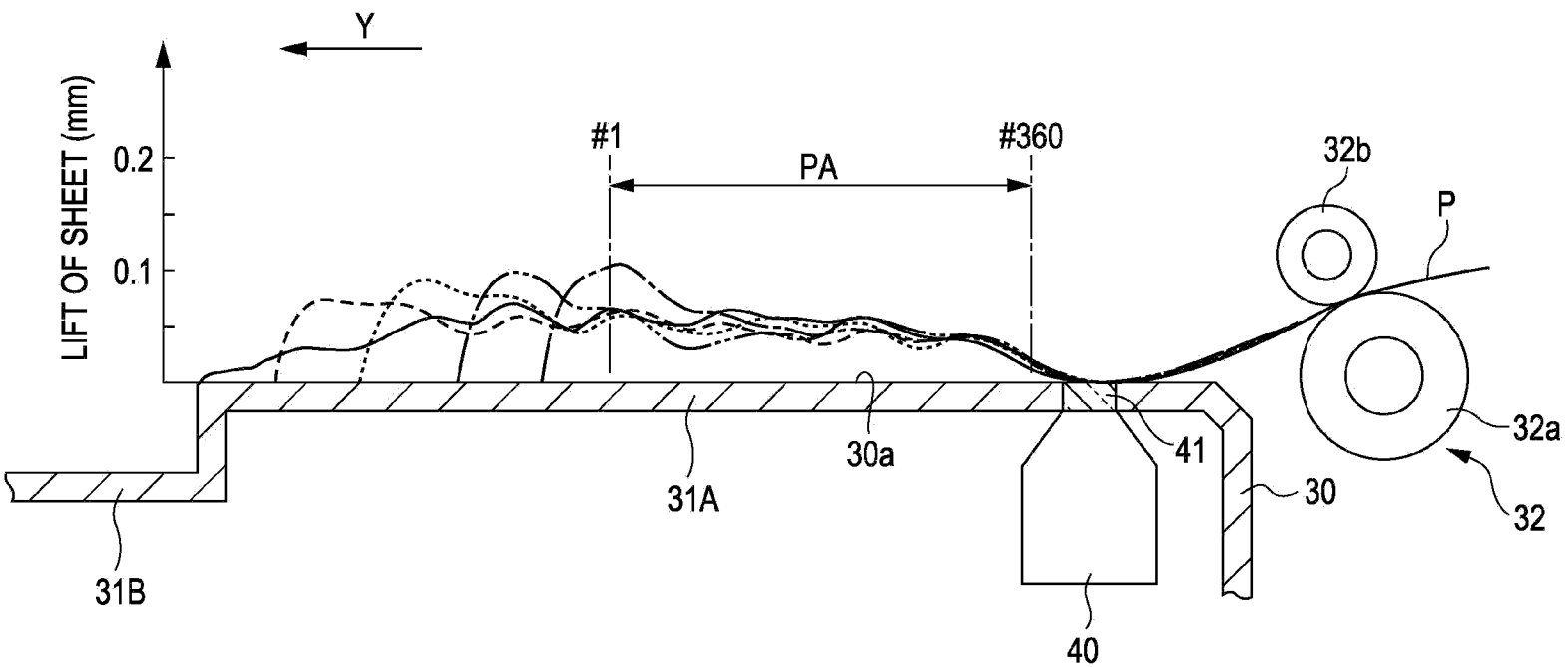
FIG. 9 is a graph which shows a lift of the paper sheet from the support table at various transportation positions.

FIG. 9 shows the amount that the paper sheet P is lifted (lift of sheet) when the paper sheet P is located in the first segment. In FIG. 9, the lift of sheet at five different transportation positions of the paper sheet P are each indicated by different types of line. Each of the transportation positions are defined by different distances from the position of the most downstream nozzle #1 (reference position) to the leading edge of the paper sheet P.

As seen from FIG. 9, when the paper sheet P is located within the first segment, the paper sheet P having the curled leading edge is lifted up downstream with respect to the abutment position in the transportation direction Y at all the transportation positions. Although the lift of sheet in the graph of FIG. 9 is shown as in the order of 0.05 to 0.1 mm, the lift of sheet varies depending on the thickness of the paper sheet P or the extent of curl (strength of curl). As the leading edge of the paper sheet P moves from the first support section 31A to the second support section 31B, the lift of sheet decreases as indicated by the solid line in the graph of FIG. 9. Then, when the paper sheet P at the transportation position indicated by the solid line is further transported and the leading edge of the paper sheet P reaches the second support section 31B, the reaction force of the curl almost disappear and the paper sheet P is attached to the holding surface 30*a* of the first support section 31A due to the suction force (negative pressure) applied to the suction holes 35, 36 (see FIG. 8B).

As can be seen from the graph of FIG. 9, when the paper sheet P having the curled leading edge is fed out, regardless of where the leading edge of the paper sheet P is positioned in the first segment before it reaches the second support section 31B, the paper sheet P fed out from the pair of transportation rollers 32 at the guide angle always abuts against the holding surface 30*a* at a position where it is pressed against the holding surface 30*a*. In this embodiment, the positioning of the imaging unit 40 is determined such that the translucent glass 41 is located at a position where the paper sheet P is pressed to abut against the holding surface 30*a*, which is upstream with respect to the print area PA in the transportation direction.

Next, an operation of the printer 11 according to this embodiment will be described below. When the printer 11 receives print data from a host device, it starts printing of the received print data. The computer 51 in the controller 50 controls feeding, transportation, recording and output of the paper sheet P according to commands obtained by interpreting the print data. First, the feed motor 62 and the transportation motor 65 are driven so as to feed the paper sheet P to the print start position according to commands of feeding. After feeding, printing of images onto the paper sheet P according to print data is performed by alternatively repeating a recording operation in which ink droplets are ejected from the recording head 19 while the carriage 18 moves in the main scan direction X so as to perform recording for one pass onto the paper sheet P and a transportation operation in which the paper sheet P is transported by a specified transportation distance to the next recording position. The paper sheet P may be curled in some cases.

In feeding, the paper sheet P is fed out from the pair of transportation rollers 32 at the guide angle in obliquely downward direction so that the leading edge of the paper sheet P enters the intersection position Pc on the holding surface 30*a* as shown in FIG. 7A. Then, when the paper sheet P is further transported, the paper sheet P which curves downward abuts against the holding surface 30*a* at the abutment start position Pa which is downstream with respect to the intersection position Pc in the transportation direction Y as shown in FIG. 7B.

When the paper sheet P is further transported, the abutment start position Pa of the paper sheet P on the holding surface 30*a* remains almost the same. Accordingly, a portion of the paper sheet P downstream with respect to the abutment start position Pa in the transportation direction Y abuts against the holding surface 30*a*. At this point, the paper sheet P is attached to the holding surface 30*a* due to the negative pressure applied to the suction holes 35, 36. Then, in the transportation operation process, the paper sheet P is transported in the state being in contact with the holding surface 30*a*.

In this embodiment, since the translucent glass 41 that serves as the detection window is disposed downstream with respect to the intersection position Pc in the transportation direction Y, specifically downstream with respect to the abutment start position Pa in the transportation direction Y, the paper sheet P is transported in the state being almost in contact with the translucent glass 41. Since the imaging unit 40 focuses on the backside of the paper sheet P, the imaging unit 40 outputs the focused image of the texture at a constant time interval.

As shown in FIGS. 8A and 8B, the paper sheet P may have a curved leading edge that curves downward. As shown in FIG. 8A, the paper sheet P having a curved leading edge is transported in the state being lifted from the holding surface 30*a* since the amount of force due to the curl of the leading edge is greater than that of the suction force from the suction holes 35, 36. When the leading edge of the paper sheet P is positioned within the first segment in which the leading edge of the paper sheet P is located on the first support section 31A, although a portion of the paper sheet P which is located from the proximity of the abutment start position Pa to the leading edge of the paper sheet P is lifted from the holding surface 30*a*, a portion of the paper sheet P at a position of the translucent glass 41 is pressed and almost abuts against the holding surface 30*a* as shown in FIG. 9. As a result, the imaging unit 40 focuses on the backside of the paper sheet P, and the imaging unit 40 outputs the focused images of the texture at a constant time interval.

In the print area PA shown in FIG. 6 and FIG. 9, the ink droplets ejected from the nozzles 19*a* of the recording head 19 land on the paper sheet P. In the case of printing having little margin such as photography printing, cockling occurs in the print area PA of the paper sheet P and an area downstream therefrom in the transportation direction Y, when the paper sheet P swells with ink and is wrinkled. The lift of the paper sheet P caused by such a cockling may not be removed by suctioning of the suction device 68. If lift of the paper sheet P caused by cockling occurs at a position of the translucent glass 41, the image captured by the imaging unit 40 is blurred at a position corresponding to the lifted portion of the paper sheet P. Further, if ink mist flows into a gap which is formed by lifting of the paper sheet P due to cockling, the translucent glass 41 may be smudged.

In this embodiment, since the translucent glass 41 is disposed at a position upstream with respect to the print area PA in the transportation direction Y, cockling does not occur at a portion of the paper sheet P which covers the translucent glass 41. Accordingly, there is no risk of image blur due to cockling and smudging of the translucent glass 41 by ink mist. Further, even if the paper sheet P having the curled leading edge is partially lifted from the holding surface 30*a* as shown in FIGS. 8A and 9, a portion of the paper sheet P which corresponds to the translucent glass 41 is pressed against the holding surface 30*a* to abut against the translucent glass 41. Accordingly, the translucent glass 41 is protected from ink mist.

Moreover, in this embodiment, the imaging unit 40 is disposed at a position opposite to the paper sheet P with respect to the holding surface 30*a* of the support table 30 so that the imaging unit 40 captures the image of the backside of the paper sheet P. Accordingly, the imaging unit 40 can focus on the backside of the paper sheet P without taking into consideration the thickness of the paper sheet P. As a result, high detection accuracy of the position of the paper sheet P can be achieved regardless of the thickness of the paper sheet P.

Based on the images captured by the imaging unit 40 at a constant time interval, the computer 51 sequentially calculates the shift amount $\Delta y$ of the paper sheet P per unit drive time according to the template matching process, and calculates the actual transportation distance by summing the shift amounts $\Delta y$ per unit drive time in one transportation process. Then, the computer 51 compares the actual transportation distance and the target transportation distance and applies a feedback correction calculation for reducing the difference between the actual transportation distance and the target transportation distance to the next required transportation distance, so as to calculate the next corrected target transportation distance. Since the feedback control of the transportation operation is performed, the paper sheet P is transported to the transportation position with relatively high accuracy. As a result, the ink droplets ejected from the recording head 19 land on the paper sheet P at appropriate positions, thereby enabling high printing quality.

According to the above-mentioned embodiment, the following effect can be obtained:

(1) The entering direction of the paper sheet P from the pair of transportation rollers 32 onto the holding surface 30*a* of the support table 30 is determined so as to intersect the plane of the holding surface 30*a*, and the imaging unit 40 is disposed such that the detection area is located at a position downstream with respect to the intersection position between the entering direction of the paper sheet P and the holding surface 30*a* in the transportation direction Y. Specifically, in this embodiment, the imaging unit 40 is disposed such that the detection area is located at a position downstream in the transportation direction Y with respect to the abutment start position Pa where the paper sheet P that has been fed out from the pair of transportation rollers 32 is pressed against the holding surface 30*a* in the state being slightly curved upward and starts to abut against the holding surface 30*a*. Accordingly, since the imaging unit 40 can capture the image of a portion of the paper sheet P which is not easily lifted from the holding surface 30*a*, it is possible to prevent the out-of-focus due to lifting of the paper sheet P and to output the texture images that are focused by the imaging unit 40. Therefore, it becomes easy to prevent the detection accuracy of the position of the paper sheet P from being decreased due to lifting of the detection area of the paper sheet P, and it is possible to improve the detection accuracy of the position of the paper sheet P.

(2) The imaging unit 40 is disposed such that the translucent glass 41 that serves as the detection window is located at a position on the holding surface 30*a* of the support table 30 downstream with respect to the intersection position Pc in the transportation direction Y and upstream with respect to the print area PA (that is, the position of the most upstream nozzle #360) of the recording head 19 in the transportation direction Y. Accordingly, there is no risk of lifting of the paper sheet P due to cockling of a portion of the paper sheet P which corresponds to the translucent glass 41. As a result, there is no risk of decrease in detection accuracy of the position of the paper sheet P due to lifting of the paper sheet P caused by cockling.

(3) Since the imaging unit 40 captures the image of a portion of the paper sheet which is supported on the holding surface 30*a*, the image captured by the imaging unit 40 can be prevented from being blurred. Accordingly, relatively high detection accuracy of the position of the paper sheet P based on the image can be achieved. For example, in the recording apparatus described in JPA-2007-217176 and JP-A-2003-267591, since a portion of the medium which is not supported on the support table serves as a detection area of the detector, a portion of the medium which corresponds to the detection area may be displaced in the directions of the front side and backside of the medium. In this embodiment, since the detection area of the imaging unit 40 is held on the holding surface 30*a*, the medium is not displaced out of the expected transportation path into the direction of the backside. Therefore, high detection accuracy of the position of the medium can be achieved with ease, compared to the recording apparatus described in JP-A-2007-217176 and JP-A-2003-267591.

(4) The imaging unit 40 is disposed at a position opposite to the paper sheet P with respect to the holding surface 30*a* and is configured to captures the image of the backside of the paper sheet P. Accordingly, it is possible to obtain a focused image of texture regardless of the thickness of the paper sheet P. For example, if the imaging unit is configured to capture the image of the front side of the paper sheet P (the surface to be printed), a focal distance from the imaging unit to the paper sheet varies depending on the thickness of the paper sheet P and the image captured by the imaging unit may be blurred depending on the thickness of the paper sheet P. In this case, the detection accuracy of the transportation distance of the paper sheet decreases, since a pattern matching process is performed based on the blurred image. In order to avoid this problem, it is necessary to use an imaging unit having an automatic focus adjustment function that automatically adjusts the focus depending on the thickness of the paper sheet P. In this case, however, a configuration of the imaging unit becomes complicated and a cost of the imaging unit increases. According to this embodiment, since the imaging unit 40 captures the image of the backside of the paper sheet P, the imaging unit 40 can consistently focus on the backside of the paper sheet P regardless of the thickness of the paper sheet P. Therefore, since the imaging unit 40 can consistently focus on the backside of the paper sheet P in capturing the image of texture, it is possible to accurately detect the transportation position and the actual transportation distance of the paper sheet P regardless of the thickness of the paper sheet P, even if the imaging unit 40 is configured to be fixedly mounted on the support table 30.

(5) The imaging unit 40 is disposed at a position opposite to the paper sheet P with respect to the holding surface 30*a*. Accordingly, when ink is ejected from the recording head 19 during printing, the translucent glass 41 (detection window) of the imaging unit 40 is covered by the paper sheet P. Therefore, it is possible to reduce smudging of the translucent glass 41 that serves as the detection window of the imaging unit 40 due to ink mist ejected from the recording head 19. For example, if the detector is configured to detect the front side (the surface to be printed) of the paper sheet P, the detection window (for example, a cover glass or lens) of the detector is smudged with ink mist ejected from the recording head 19, which causes a detection error. According to this embodiment in which the imaging unit 40 is disposed at a position opposite to the paper sheet P with respect to the holding surface 30*a*, it is possible to reduce the occurrence of detection error due to smudging of the translucent glass 41, since there is low risk that the translucent glass 41 which serves as the detection window is smudged with ink mist.

The following modifications may be made to the above-mentioned embodiment:

The detection area of the medium to be detected by the detector may be located at a position inside or partially inside the recording area of the recording unit as long as the detection area is located at a position downstream in the transportation direction with respect to the intersection position between the entering direction of the medium being fed out from the transportation unit and the holding surface of the support table. For example, the translucent glass 41 of the imaging unit 40 may be disposed inside or partially inside the print area PA, as long as the translucent glass 41 is disposed at a position downstream with respect to the intersection position Pc in the transportation direction. With this configuration, it is possible to reduce lifting of the medium by using a force for pressing the medium against the holding surface. For example, in a configuration in which the medium is pressed against the holding surface at a position upstream with respect to the suction holes of the suction device (attaching unit) in the transportation direction, it is highly possible that the medium is attached on the holding surface due to a relatively high negative pressure applied to the suction holes with high possibility even if the medium has a curl. Accordingly, in the case where the medium abuts against the holding surface due to a relatively strong suction force applied to the suction holes even if the medium has a curl, or in the case where the lifting is within an acceptable range of detection accuracy of the position of the medium even if the medium is lifted from the holding surface, the detection area or the detection window may be disposed at a position inside or partially inside the recording area of the recording unit as long as the detection area or the detection window is disposed at a position downstream with respect to the intersection position on the holding surface in the transportation direction. However, in these cases, it is desirable that the detection area or the detection window is disposed at a position upstream with respect to the recording area in the transportation direction.

The medium may be curled in the direction opposite to that is shown in FIGS. 8A and 8B. Even if the medium is curled in the opposite direction, occurrence of lifting of the medium at the detection area can be reduced by setting the detection area of the medium at a position downstream with respect to the intersection position Pc in the transportation direction, specifically downstream with respect to the abutment start position Pa in the transportation direction, thereby reducing a decrease in detection accuracy of the position of the medium by the detector.

The holding surface of the support table is not limited to a horizontal plane, but may also include a surface inclined at a specified angle to the horizontal plane. In this configuration, the transportation unit that feeds out the medium so that the transportation direction of the medium intersects the inclined holding surface may be used.

The support table that does not have the suction device 68 may be used. Since the paper sheet P can be pressed against the holding surface 30*a* without using the suction device, a decrease in detection accuracy due to lifting of the paper sheet can be reduced.

Although the detector is disposed at a position where the detector can detect the backside of the medium which is opposite to the recording surface in the above embodiment, the detector may be disposed at a position where the detector can detect the front side of the medium which is the recording surface. For example, a configuration is possible in which the imaging unit is disposed at a position on the side of the recording surface of the medium and away from the recording surface so as to capture the image of a portion of the medium which is pressed against the support table as an imaging area (detection area). Further, a configuration is also possible in which a camera is disposed on the side of the recording surface of the medium and away from the recording surface as disclosed in JP-A-2007-217176, and a configuration is also possible in which a speckle pattern generated in the light reflected from the paper sheet is detected when a laser light is emitted to the front side (recording surface) of the paper sheet as disclosed in JP-A-2003-267591. In a configuration in which the imaging unit 40 that is disposed at a position above the support table 30 captures the image of the front side (recording surface) of the paper sheet P, it is possible to detect the position of the paper sheet based on the captured image (frame) by capturing the image of a portion of the surface of the paper sheet P which is located upstream with respect to the print area PA (recording area) of the recording head 19 (in other words, the most upstream nozzle).

A configuration is possible in which markings are marked on the medium equally spaced in the transportation direction, so that the markings are detected based on the difference of the light intensity of the light reflected from the medium due to presence and absence of the marking, and the position of the medium is obtained by counting the number of detected markings.

Although the detector is disposed at a position in the proximity of the center in the paper sheet width direction (main scan direction X) in the above embodiment, the detector may be disposed at any other position in the paper sheet width direction as long as being capable of detecting the medium. For example, the detector may be disposed at an end in the paper sheet width direction.

A configuration is possible in which the transportation unit also includes a pair of output rollers disposed at a position downstream with respect to the pair of transportation rollers 32 and the support table 30 in the transportation direction Y.

The transportation unit is not limited to a roller transportation type, but may also include a belt transportation type. In the belt transportation type transportation unit, there is no risk of a decrease in detection accuracy of the detector as long as a transportation belt device feeds out the medium onto the holding surface of the support table at an angle so as to intersect the plane of the holding surface.

The non-contact detector may be a light intensity sensor that detects the positions of the markings marked on the medium equally spaced in the transportation direction based on the intensity of the light reflected from the medium. The marking may be a mark printed on the paper sheet or a hole (for example, punched hole) punctured in the paper sheet. With this configuration, the position can be detected on the medium that substantially does not have a texture, such as a resin film. Further, the detector may be a motion sensor that emits a coherent light to the medium and detects the transportation position of the medium by using a speckle pattern generated in the light reflected from the medium. Further, the non-contact detector is not limited to an optical sensor such as imaging unit, light intensity sensor, motion sensor, but may also include a Doppler sensor that uses sound (for example, ultrasound). When the speed of the medium (positional information) is detected by the Doppler sensor, the position or transportation distance of the medium can be obtained from the product of the detected speed and time.

The positional information of the medium detected by the detector is not limited to at least one of the position and transportation distance of the paper sheet. For example, it is possible to obtain the speed of the medium based on the positional information detected by the detector and controls, for example, the speed of the medium based on the obtained speed of the medium.

The medium is not limited to a short strip-shaped medium such as a cut sheet, but may also include an elongated strip-shaped medium such as a rolled paper. Although the elongated strip-shaped medium such as a rolled paper that is stored in the form of a roll (in a wound state) has a curl and lifting of the medium from the support table is likely to occur, the detection accuracy of the medium can be improved since a portion of the medium which is pressed against the support table and abuts against the holding surface serves as the detection area.

The medium is not limited to a paper sheet, but may also include a resin film, metallic foil, metallic film, composite film of resin and metal (laminated film), fabric, non-woven fabric and ceramic sheet. Further, the medium may be a solid having a flat plane (the surface to be imaged) which extends in the transportation direction.

Although the recording apparatus is embodied as an ink jet recording apparatus in the above embodiment, the invention is not limited thereto, and may also be embodied as a liquid ejection apparatus that ejects liquid other than ink or a liquid material (including a fluid material such as a gel) containing particles of functional material dispersed or mixed in a liquid. For example, a liquid ejection apparatus that ejects a liquid material containing materials such as electrode material and color material (pixel material) in a dispersed or dissolved state, which are used for manufacturing of liquid crystal displays, EL (electroluminescence) displays, surface emitting displays and the like may be used. Further, a liquid ejection apparatus that ejects bioorganic materials used for manufacturing biochips and a liquid ejection apparatus that is used as a precision pipette and ejects the liquid of a sample may also be used. In addition, a liquid ejection apparatus that ejects transparent resin liquid such as a thermoset resin onto a substrate for manufacturing of minute hemispheric lenses (optical lenses) used for optical communication elements or the like, a liquid ejection apparatus that ejects acid or alkali etching liquid for etching a substrate or the like, and a fluid ejection apparatus that ejects a fluid such as a gel (for example, a physical gel) may also be used. The invention may be applied to any one of the above-mentioned liquid ejection apparatuses. The medium may include a substrate on which elements and wirings are formed by ink jet. The "liquid" as used herein includes a liquid (such as inorganic solvent, organic solvent, liquid solution, liquid resin and liquid metal (molten metal)), a liquid material and a fluid material.

The recording unit is not limited to that of an ink jet recording type (liquid ejecting type), but may also include that of a dot impact recording type. Further, the recording apparatus is not limited to a serial printer, and may include line printer.

The medium transportation device is not limited to the recording apparatus such as a printer, but may also include, for example, a scanner that transports a medium for reading the image recorded on the medium, a cutting machine that transports a paper sheet for cutting the paper sheet, a paper sheet processing machine that transports a paper sheet for processing the paper sheet, an application machine that transports a medium for applying liquid such as adhesion and water with a brush or application roller and a packaging machine that transports a packaging paper sheet to a packaging mechanism for packaging an article. In addition to that, other apparatuses having a medium transportation device that transports a medium may also be used. As a matter of course, the medium transportation device dedicated for transportation of a medium may be solely used.

The "positional information of the medium" detected by the detector is not limited to the image (frame) of the medium captured at a constant time interval, but also may include, for example, a detection signal for an optical sensor that optically detects the positions of markings marked on the front side or backside of the medium at a constant interval in the transportation direction, or a detection signal for a Doppler sensor that detects the position of the medium. That is, the positional information of the medium may be information from which the position can be directly derived, or information from which the position can be derived by applying a specified processing such as image processing and signal processing. Alternatively, control information other than the position of the medium used for transportation of the medium may be derived from the positional information of the medium.

The entire disclosure of Japanese Patent Application No. 2011-266551, filed Dec. 6, 2011 is expressly incorporated by reference herein.

What is claimed is:

1. A medium transportation device comprising:

a transportation unit that transports a medium;

a medium holding member having a holding surface on which the medium to be transported by the transportation unit is held;

a non-contact detector that obtains positional information of the medium by detecting the medium which is held on the holding surface in a non-contact manner;

a recording unit that performs recording by ejecting liquid onto the medium held on the holding surface; and a transportation control unit that controls transportation by the transportation unit based on the information obtained by U detector, wherein an entering direction of the medium transported by the transportation unit onto the holding surface is determined so as to intersect the plane of the holding surface, the detector is disposed such that a detection area is located at a position downstream in a transportation direction with respect to the intersection position between the entering direction of the medium and the holding surface and upstream with respect to the recording area in the transportation direction, and the intersection position is located at a position upstream with respect to a recording area of the recording unit in the transportation direction.

2. The medium transportation device according to claim 1, wherein the detector is disposed at a position opposite to the medium with respect to the holding surface.

3. The medium transportation device according to claim 2, wherein the detector has a detection window on the holding surface, and the detection window is disposed at a position downstream with respect to the intersection position in the transportation direction.

4. The medium transportation device according to claim 1, wherein the detector is an optical detector that obtains the positional information of the medium based on a light reflected from the medium.

5. The medium transportation device according to claim 1, wherein the transportation control unit calculates an actual transportation distance of the medium based on the positional information of the medium obtained by the detector and controls the transportation unit with feedback control so as to approximate the actual transportation distance to a target: transportation distance.

* * * * *